United States Patent [19]

Takenouchi et al.

[11] Patent Number: 4,973,542

[45] Date of Patent: Nov. 27, 1990

[54] TRANSFER RECORDING MEDIUM

[75] Inventors: Masanori Takenouchi, Atsugi; Masashi Miyagawa, Kawasaki; Norio Ohkuma, Tokyo, all of Japan

[73] Assignee: Canon Kabushiki Kaisha, Tokyo, Japan

[21] Appl. No.: 130,555

[22] Filed: Dec. 8, 1987

[30] Foreign Application Priority Data

Dec. 9, 1986 [JP] Japan ..... 61-291627

[51] Int. Cl.[5] ..... G03C 1/68; G03C 1/72

[52] U.S. Cl. ..... 430/138; 430/253; 430/281; 428/195; 428/402.2; 428/402.24; 428/913; 428/914

[58] Field of Search ..... 430/138, 253, 281, 41, 430/42, 46, 901, 284, 285; 428/195, 913, 914, 402.2, 402.24

[56] References Cited

U.S. PATENT DOCUMENTS

| | | | |
|---|---|---|---|
| 4,440,846 | 4/1984 | Sanders et al. | 430/138 |
| 4,599,294 | 7/1986 | Matianoto et al. | 430/138 |
| 4,608,330 | 8/1986 | Marabella | 430/138 |
| 4,632,899 | 12/1986 | Takeda | 430/292 |
| 4,661,430 | 4/1987 | Wakamiya | 430/120 |
| 4,675,269 | 6/1987 | Saccocio et al. | 430/138 |
| 4,701,397 | 10/1987 | Rourke et al. | 430/138 |
| 4,713,312 | 12/1987 | Adair et al. | 430/138 |
| 4,792,514 | 12/1988 | Nakamura et al. | 430/138 |

FOREIGN PATENT DOCUMENTS

| | | | |
|---|---|---|---|
| 0205083 | 12/1986 | European Pat. Off. | 400/120 |

*Primary Examiner*—Paul R. Michl
*Assistant Examiner*—Patrick Doody
*Attorney, Agent, or Firm*—Fitzpatrick, Cella, Harper & Scinto

[57] ABSTRACT

A transfer recording medium comprises a substrate and a transfer recording layer disposed thereon capable of changing its transfer characteristic when provided with light energy and heat energy. The transfer recording layer comprises image forming elements which are solid at room temperature and comprise at least a colorant and a functional component sensitive to the provision of light energy and heat energy. Since the image forming elements have a mode particle size of 5–25 μm and comprise 50% by number or more of those having a particle size of ±4 μm or less from the mode particle size, the transfer recording medium affords a clear transferred image with high resolution at a high transfer rate when provided with light and heat energies, at least one of which is applied imagewise.

7 Claims, 7 Drawing Sheets

EXAMPLE 1

EXAMPLE 3

EXAMPLE 2

EXAMPLE 4

COMPARATIVE EXAMPLE 1

TRANSFER RECORDING MEDIUM

FIELD OF THE INVENTION AND RELATED ART

The present invention relates to a transfer recording medium applicable for printers, copying machines, and facsimile machines.

In recent years, accompanying the rapid progress of the information industry, various information processing system have been developed, and various recording methods, and apparatus have been developed corresponding to the respective information processing systems. Such recording method, the thermal or heat-sensitive transfer recording method, has advantages in that the apparatus employed is light weight, compact, free of noise, excellent in operability and adapted to easy maintenance, and accordingly has been recently widely used. According to this method, plain paper can be used as a transfer-receiving medium or a medium to be transfer-printed.

However, the heat-sensitive transfer recording method of the prior art is not free from drawbacks. That is, according to the heat-sensitive transfer recording method of the prior art, the transfer recording performance, namely the printed letter quality, is strongly influenced by the surface smoothness of the transfer-receiving medium, and therefore while good printing can be effected on a transfer-receiving medium having high smoothness, the printed letter quality will be markedly lower in the case of a transfer-receiving medium with low smoothness. Although paper, which is the most typical transfer-receiving medium may be used problems are present. A paper with high smoothness is rare while ordinary paper has surface unevenness to various degrees because is formed through entanglements of fibers. As a result, according to the conventional thermal transfer recording method, the resulting printed image on paper may not be sharp at the edge portion or a part of the image may be missing thus lowering the printer letter quality.

Further, in the conventional thermal transfer recording method, while the transfer of an ink layer to the transfer-receiving medium is caused by only the heat supplied from a thermal head, it is difficult even from a theoretical point of view to increase the heat supply from the thermal head. That is a problem because it is required to cool the thermal head to a prescribed temperature in a limited short time and it is also are necessary to prevent occurrence of thermal crosstalk between heat-generation segments or elements constituting the thermal head face. For this reason, high speed recording has been difficult to realize according to the conventional thermal transfer recording method.

Further, as heat conduction has a slow response speed compared with electricity or light, it has been generally difficult to control a heat pulse sufficient to reproduce a medium tone by conventional recording system using a transfer medium, and also it has been impossible to effect a medium tone recording as the conventional thermal transfer ink layer lacks a transfer function for gradational representation.

Further, in the conventional thermal transfer recording method, it has been only possible to obtain one image color through one transfer operation, and accordingly, it has been necessary to repeat the transfer step several times to superpose colors in order to obtain a multi-color image. Since it is very difficult to exactly superpose images of different colors it has been difficult to obtain an image free of color deviation or aberration. Particularly, when one picture element is involved, superposition of colors has not been effected in such a one-picture element, and consequently, a multi-color image has been constituted by assembly or gathering of picture elements involving color deviation in the conventional thermal transfer recording method. For this reason, it has been impossible to obtain a clear multi-color image according to the conventional thermal transfer recording method.

Further, when it is desired a multi-color image by the conventional thermal transfer recording methods, there have been attended difficulties such as provision of plural thermal heads or complex movements involving reversal of direction and stopping of media to be printed which requires a large and complex apparatus or a decrease in recording speed.

There has been proposed a transfer imaging method for producing a multicolor image by using a color precursor (chromogenic material) and a developer (U.S. Pat. No. 4,399,209). More specifically, in this method, an imaging sheet comprising a substrate and a coating thereon comprising a chromogenic material and a radiation curable composition encapsulated in rupturable capsules, is provided; the coating is subjected to image-wise exposure with actinic radiation to cure the radiation-curable composition and form a latent image and the latent image is superposed onto a developer sheet to form a visible, image on the developer sheet. In such methods, only light energy is used for forming a latent image on a transfer recording medium image sheet), so that a recording medium highly sensitive to light or a light flux of a high energy is required in order to obtain a clear image at a high speed. A high sensitivity recording medium generally has a poor storage stability and is therefore not appropriate for easy handling. Further, it is difficult to obtain a high energy required for curing a radiation-curable composition at a high speed with a single kind of energy, particularly a light energy, thus a large size apparatus has been generally required.

Further, the highly sensitive recording medium utilizing a photoreaction alone also has high sensitivity even when it is not exposed to light, and therefore such recording medium has the serious disadvantage of poor storage stability near room temperature.

Further, a large-size apparatus is also required for multi-color recording in order to obtain a high light energy thus the cost of such apparatus can be substantial.

Further, in the above-mentioned method, since only light energy is used for forming a latent image on a transfer recording medium, it is not suitable in a case where an image is outputted depending on an external signal in an apparatus such as a printer, or in a case where image information read from a multi-color original is converted into a digital signal by using a color image scanner and then imparted to a recording medium. More specifically, a light flux having a shorter wavelength, mainly of an ultraviolet ray, is required in order to radiate a light of high energy, but there has not been obtained a light source which can digitally control an ultraviolet ray. For example, an optical head such as a liquid crystal shutter array and an LED array has been proposed in order to obtain a digital light source. However, although these heads are suitable for miniaturization, an ultraviolet ray cannot be used therein because liquid crystal molecules deteriorate in an ultraviolet wavelength region.

Further, in the above recording system, a color-forming reaction of a leuco dye is utilized so that the resultant recorded image is essentially inferior in stability.

Further, in order to facilitate the development through pressure-application, material enclosed in the micro-capsules is required to be formed as a photosensitive composition which is liquid at room temperature and provides a poor storability. Moreover, the resultant image is accompanied with an odor of a monomer because a nonreacted material is ruptured, thus providing a practically undesirable characteristic.

In order to solve the above-mentioned problems, an image forming method has been proposed wherein a transfer recording is effected on a transfer-receiving medium such as paper by using plural kinds of energies (U.S. patent application Ser. No. 869,689).

Futher, a recording method has been proposed wherein the above-mentioned recording method of U.S. patent application Ser. No. 869,689 is improved in fixing (U.S. patent application Ser. No. 927,876), and a recording method wherein a vaporizable dye is applied to the above recording method (U.S. patent application Ser. No. 070,194).

SUMMARY OF THE INVENTION

A principal object of the present invention is to provide a transfer recording medium which is suitably used in the above-mentioned series of image-forming methods proposed by our research group which have solved the problems of the conventional methods as mentioned above, i.e., the methods which can provide transferred images of a high quality, are capable of effecting high-speed recording and medium tone recording and can provide clear multi-color images free of color deviation without accompanying complicated movement of a transfer recording medium.

A more specific object of the present invention is to provide a transfer recording medium which is suitably used in the above-mentioned image-forming methods and which is capable of providing a recorded image having a high image density and high resolution.

According to the present invention, there is provided a transfer recording medium comprising a substrate and a transfer recording layer disposed thereon capable of changing its transfer characteristic when provided with light energy and heat energy; wherein the transfer recording layer comprises image forming elements which are solid at room temperature and comprise at least a colorant and a functional component sensitive to the provision of light energy and heat energy; the functional component comprises at least a photo-initiator and a polymerizing component of a monomer, oligomer or prepolymer having an unsaturated double bond; the image forming elements have a mode particle size in the range of 5–25 $\mu$m, and the image forming elements comprise, based on the total number of particles thereof, 50% by number or more of those having a particle size of $\pm 4$ $\mu$m or less counted from the mode particle size. Herein, the term "polymerizing" is intended to also cover "crosslinking".

These and other objects, features and advantages of the present invention will become more apparent upon a consideration of the following description of the preferred embodiments of the present invention taken in conjunction with the accompanying drawings, wherein like parts are denoted by like reference numerals.

DETAILED DESCRIPTION OF THE INVENTION

The transfer recording medium according to the present invention comprises a substrate and a transfer recording layer disposed thereon. The transfer recording layer comprises a distributed layer of particulate image forming elements which are solid at room temperature (or normal temperature) and contain a functional or sensitive component sensitive to the provision of light energy and heat energy. Since the image forming element contains the functional component, the transfer recording layer changes its transfer characteristic or transferability when provided with light energy and heat energy.

In a case where a transfer recording is effected by using the transfer recording medium according to the present invention, light energy and heat energy are imparted to the transfer recording layer on the substrate under such a condition that at least one of the light energy and heat energy corresponds to a recording information signal to change its transfer characteristic, whereby a transferable portion or transferable image is formed in the transfer recording layer. Then, the transferable portion of the transfer recording layer is transferred to a transfer-receiving medium, e.g., by using heat and pressure.

In the above transfer recording method, the transferable portion may be formed by changing a physical property controlling a transfer characteristic. The physical property controlling a transfer characteristic may be determined depending on a particular type of transfer recording medium used. For example, with respect to a transfer recording medium used in a transfer mode wherein transfer of an image is effected through heat-fusion of the image, the physical property may be a melting temperature, a softening temperature, a glass transition temperature, etc. With respect to a transfer recording medium used in a transfer mode wherein transfer of image is effected by making an image to be transferred viscous or penetrable into a transfer-receiving medium, the physical property may be a viscosity at the relevant temperature.

A preferred embodiment of the image forming method using the transfer recording medium according to the present invention is explained with reference to FIGS. 1A to 1D, wherein the abscissas are indicated on a common scale of time.

The transfer recording layer contains a functional component which comprises at least a photo-initiator and a polymerizing component which is capable of being polymerized or crosslinked. In the present invention, the polymerizing component comprises a monomer, oligomer or prepolymer having an unsaturated double bond (i.e., an ethylenic double bond).

Figure 1A:
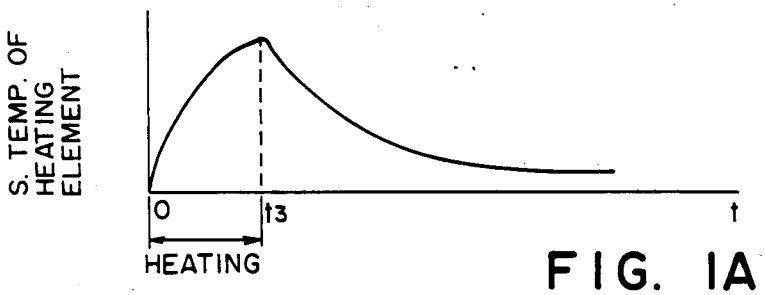
FIGS. 1A–1D show changes of several parameters with elapse of time involved in an image forming step using a transfer recording meidum according to the present invention.
Figure 1B:
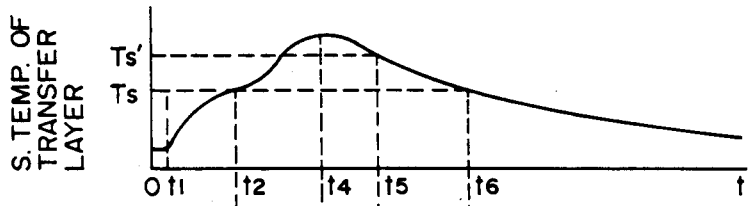

FIG. 1A shows a surface temperature change of a heating element when a heating means such as a thermal head is energized for heat generation for a period of 0–$t_3$ and subjected to temperature decrease thereafter. A transfer recording medium contacting the heating means under pressure causes a temperature change as shown in FIG. 1B corresponding to the temperature change of the heating means. More specifically, it starts to cause a temperature rise after a time delay of $t_1$ and similarly reaches the maximum temperature at time $t_4$ after time $t_3$, then followed by temperature decrease.

The transfer recording layer has a softening temperature Ts and abruptly softens to decrease its viscosity in a temperature region above Ts. The change in viscosity is shown by a curve A in FIG. 1C. Thus, after the temperature reaches Ts at time $t_2$ and ultil it reaches the maximum temperature at time $t_4$, the viscosity continually decreases, while the viscosity again increases thereafter along the temperature decrease to show an abrupt increase in viscosity until time $t_6$ when the temperature decreases to Ts. In this case, the transfer recording layer has not been basically subjected to a transfer characteristic change and shows a decrease in viscosity in the manner as described above when it is heated above Ts in a subsequent transfer step.

Accordingly, if the transfer recording layer is caused to contact a transfer-receiving medium under pressure and subjected to heating required for transfer, e.g., to a temperature above Ts, the transfer recording layer is transferred in the same transfer mechanism as involved in the conventional thermal transfer recording. In this invention, however, when the transfer recording layer is illuminated or exposed to light from $t_2$ in parallel with heating as shown in FIG. 1D, and the temperature is sufficiently increased, the transfer recording layer softens and a photo-initiator contained therein is actuated to provide a large reaction velocity, and a polymerizing component rapidly causes curing or hardening, because the probability of polymerization (or crosslinking) of the polymerizing component (i.e., a monomer, oligomer or prepolymer having an unsaturated double bond) is rapidly increased.

Figure 1C:
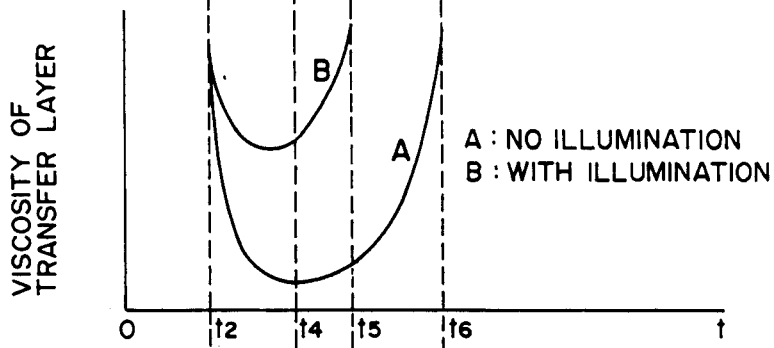
Figure 1D:
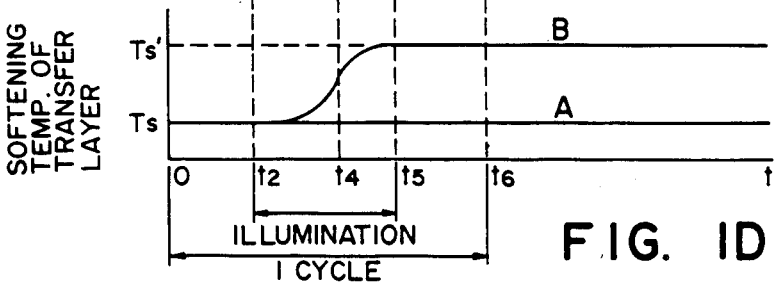

In this way, if heating and illumination are carried out, the transfer recording layer shows a viscosity change as represented by a curve B in FIG. 1C. Then, along with further progress of reaction, the softening temperature is raised from Ts to Ts' at time $t_5$ when the reaction is completed. The change in softening temperature as described above of the transfer recording layer is illustrated in FIG. 1D. Corresponding to this, the transfer recording layer is caused to have a different transfer initiation temperature, i.e., a temperature at which it starts to be transferred, from Ta to Ta'. As a result, the transfer recording layer has a portion having a transfer initiation temperature Ta' and also a portion retaining a transfer initiation temperature Ta which behave differently in a subsequent transfer step.

Now, when the transfer recording layer is heated, e.g., to a temperature Tr satisfying $Ta<Tr<Ta'$, the portion having a transfer initiation temperature Ta is selectively transferred to a transfer-receiving medium. In this instance, $Ta'-Ta$ (or $Ts'-Ts$) should preferably be about 20° C. or more, more preferably 40° C. or more while it somewhat depends on temperature stabilization accuracy during the transfer step. Such a temperature difference is the same in the case of $Ts>Ts'$.

In this way, a transferable image may be formed by controlling heating or non-heating in combination with simultaneous illumination, corresponding to an image signal.

The physical property controlling the transfer characteristic of a transfer recording layer may also be represented by another physical property such as a melting temperature, a glass transition temperature, etc., instead of the transfer initiation temperature or softening temperature as described above. In any case, a transferable image may be formed in a transfer recording layer by utilizing an irreversible change in melting temperature, glass transition temperature, etc., through the provision of plural kinds of energies. As the melting temperature and glass transition temperature change with a similar tendency as a softening temperature, the change in melting temperature or glass transition temperature may be similarly utilized in the manner as described above with respect to the softening temperature. The transfer initiation temperature mentioned herein is a value measured by the following method.

A 6 μ-thick transfer recording layer formed on a 6 μ-thick polyethylene terephthalate (PET) film is caused to contact 0.2 mm-thick wood-free paper as a transfer-receiving medium having a surface smoothness (Bekk smoothness) of 50–200 seconds. The resultant laminate of the transfer recording medium and the paper is passed at a rate of 2.5 mm/sec between a pair of rollers as follows. The first roller is a hollow cylindrical iron roller of 40 mm diameter in which a 300 W-halogen lamp heater is stored and is disposed on the side of the transfer recording medium. The second roller disposed on the side of the paper comprises a similar iron roller of 40 mm diameter coated with a 0.5 mm-thick fluorine rubber layer. The two rollers are operated to exert a linear pressure of 4 kg/cm. In the measurement, the surface temperature of the first roller is measured by a temperature sensor, e.g., a thermistor, while controlling the halogen lamp heater to provide a prescribed temperature. At a time of 4 seconds after the laminate is passed through the two rollers, the transfer recording medium is peeled off the paper moved horizontally at a peeling angle of about 90° and at a rate equal to the conveying speed of the rollers, so that it is observed whether the transfer recording layer has been transferred onto the paper. The operation is continued while generally raising the surface temperature of the first roller (at a rate of 10° C./min or less), and the minimum temperature at which the transfer starts to occur effectively (as identified by saturation of a transferred image density) is identified as the transfer initiation temperature of the transfer recording medium or the transfer recording layer.

As described above, the change in the transfer characteristic may be represented by a change in glass transition temperature Tg, softening temperature Ts or melting temperature Tm of the transfer recording layer or transfer recording medium. In order to obtain a recorded image in the subsequent transfer step, it is sufficient that the viscosity or penetrability of the transfer recording medium of the present invention changes. Even when the above-mentioned Tg, Ts or Tm does not change clearly, the transfer recording medium of the present invention is applicable.

Next, there will be explained an embodiment of multicolor image forming method wherein the characteristic of the transfer recording medium according to the present invention may be particularly preferably exhibited.

FIGS. 2A–2D are schematic partial sectional views showing a relationship between a transfer recording medium according to the present invention and a thermal head. In this embodiment, a heat energy modulated according to a recording signal is applied in combination with a light energy having a wavelength selected depending on the color of an image forming element of which the transfer characteristic is intended to be changed. Herein, "modulation" is an operation of changing a position to which the energy is applied corresponding to a given image signal, and "in combination" covers a case where the light energy and the heat energy are applied simultaneously as well as a case where the light energy and the heat energy are applied separately.

A multi-color transfer recording medium 1 according to this embodiment comprises a transfer recording layer 1*a* disposed on a base film 1*b*. The transfer recording layer 1*a* is formed as a layer of distributed minute image forming elements 31. Respective image forming elements show different color tones. In the embodiment shown in FIGS. 2A–2D, for example, each image forming element 31 contains any one colorant selected from cyan C), magenta (M), yellow (Y) and black (K). The colorants to be contained in the image forming elements 31, however, are not restricted to cyan, magenta, yellow and black, but may be colorants of any color depending on an intended use. Each image forming element 31 contains in addition to a colorant, a functional component. The image forming elements 31 may be disposed on the substrate 1*b* together with an adhesive or by heat-melting the above components.

The functional component in the image forming elements 31 has a wavelength dependency depending on the colorant contained. More specifically, an image forming element 31 containing a yellow colorant causes abrupt reaction to be cured when a heat flux and a light beam with a wavelength (Y) are applied thereto. Similarly, an image forming element 31 containing a magenta colorant, an image forming element 31 containing a cyan colorant and an image forming element 31 containing a black colorant respectively cause abrupt reaction to be cured when a heat and a light beam with a wavelength λ(M), heat and a light beam with a wavelength λ(C), and heat and a light beam with a wavelength λ(K), respectively, are applied thereto. A cured or hardened image forming element 31 does not cause decrease in viscosity or does not have adhesion even when heated in a subsequent transfer step, so that it is not transferred to a transfer-receiving medium. The heat and light are applied corresponding to an information signal to be recorded.

In this embodiment of the image forming method using the transfer recording medium according to the present invention, the transfer recording medium 1 is superposed on a thermal head 20, and light illumination is effected so as to cover the entire heat generation region or the thermal head 20. The wavelengths of the illumination light are so selected sequentially as to react on image forming elements to be illuminated. For example, if image forming elements 31 to be illuminated are colored in any one of cyan, magenta, yellow and black, light beams having a wavelength λ(C), λ(M), λ(Y) and λ(K), respectively, are successively provided.

More specifically, while the transfer recording medium is illuminated with a light beam having a wavelength λ(Y), resistance heating elements 20*b*, 20*d*, 20*e* and 20*f*, for example, of the thermal head are caused to generate heat. As a result, among the image forming elements 31 containing a yellow colorant, those applied with the heat and the light beam with a wavelength λ(Y) are cured as shown by hatching in FIG. 2A (In FIGS. 2B, et seq., the cured elements are also indicated by hatching).

Figure 2A:
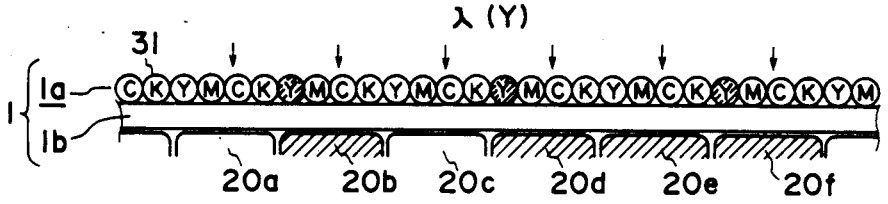
FIGS. 2A–2D are schematic partial sectional views showing a relationship between a transfer recording medium and a thermal head involved in a multi-color transfer recording mode according to the present invention.
Figure 2B:
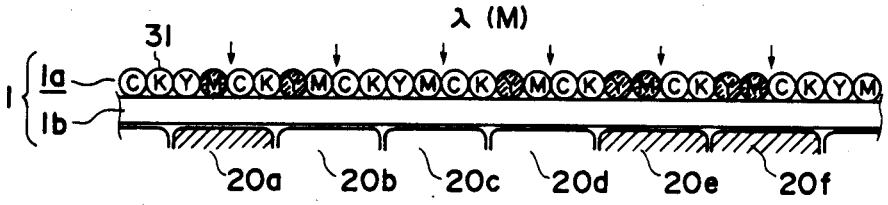
Figure 2C:
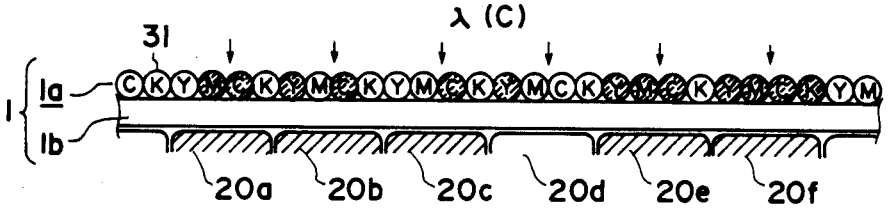
Figure 2D:
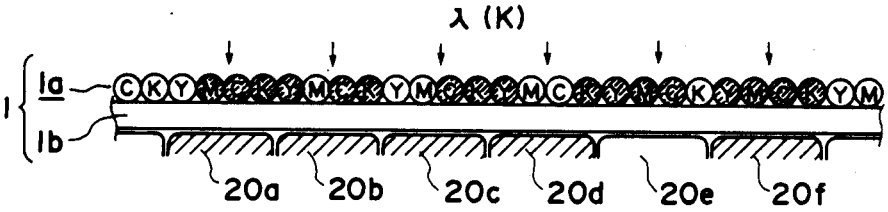
Figure 2E:
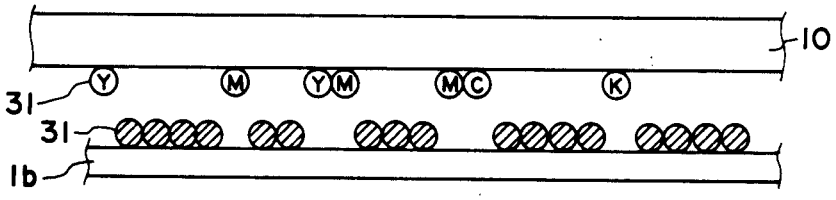

Then, as shown in FIG. 2B, while the transfer recording layer 1*a* is illuminated with a light beam with a wavelength λ(M), resistance heating elements 20*a*, 20*e* and 20*f* are caused to generate heat, whereby among the image forming elements containing a magenta colorant, those applied with the heat and the light beam with a wavelength λ(M) are cured. Further, as shown in FIGS. 2C and 2D, while the light fluxes with wavelengths λ(C) and λ(D) are provided, prescribed resistance heating elements are caused to generate heat, whereby image forming elements applied with the heat and light are cured to finally leave a transferable image formed of non-cured image forming elements 31. The transferable image is then transferred to a transfer-receiving medium 10 in a subsequent transfer step as shown in FIG. 2E.

In the transfer step, the transfer recording medium on which the transferable image has been formed is caused to contact the transfer-receiving medium 10 through the faces and heat is applied from the transfer recording medium side or the transfer-receiving medium 10 side, whereby the transferable image is selectively transferred to the transfer-receiving medium 10 to form a visible image thereon. Accordingly, the heating temperature in the transfer step is so determined in connection with the change in transfer characteristics that the transferable image is selectively transferred. Further, in order to effectively carry out the transfer, it is also effective to apply a pressure simultaneously. The pressurization is particularly effective when a transfer-receiving medium having a low surface smoothness is used. Further, where the physical property controlling a transfer characteristic is a viscosity at room temperature, the pressurization alone is sufficient to effect the transfer.

The heating in the transfer step is suitable for producing a durable multi-color image with a stability and an excellent storability.

In the above embodiment explained with reference to FIGS. 2A to 2D, the entire area of the thermal head 20 is illuminated with light while resistance heating elements of the thermal head 20 are selectively energized. On the contrary, while a certain area of the transfer recording medium are uniformly heated, e.g., by energizing all the resistance heating elements of the thermal head 20 shown in FIG. 2A, light illumination may be effected selectively or imagewise to form a similar multi-color image. More specifically, light energy having a wavelength modulated according to a recording signal and selected depending on the color of an image forming element of which the characteristic is intended to be changed, is imparted along with heat energy.

In the image forming method using the transfer recording medium according to the present invention, as described above, a transferable image is formed and then transferred to a transfer-receiving medium. Accordingly, the particle size of the image forming element has much effect on the image quality of a transferred image to be finally obtained. Therefore, in the transfer recording medium according to the present invention, there are used image forming elements having a mode particle size in the range of 5–25 μm.

Herein, "mode particle size" is the value of a particle size in a particle size distribution curve for which the number of particles is a maximum.

In the present invention, the mode particle size of the image forming elements may be determined in the following manner by means of an image analyzing device.

Thus, image forming elements on a substrate are horizontally disposed so that they are on a microscope side, and then images of the image forming elements through an optical microscope are detected by means of a television camera. At this time, the magnification is appropriately set so that at least 20 particles of image forming elements are present in the measurement area of a monitor. Then, while direct images of the image forming elements on the monitor are observed, the binary or digitized images thereof are obtained by a digitizing process. At this time, another particle image hindering the particle size measurement such as a foreign particle image may be omitted by use of image processing. Further, two or more of image forming elements which are mutually disposed too closely and can be detected as a single particle may be measured separately by use of image processing.

In the present invention, an absolute maximum length (i.e., the maximum length of distances between two points which are arbitrarily selected on the periphery of each particle image) may be selected as a particle size. By using classification intervals of 1 μm, the numbers of the image forming elements corresponding to the respective classification intervals are measured. Such operation is repeated to accumulate the results, while changing the measurement position so that the total number of the measured image forming elements becomes at least 2,000 whereby a particle size distribution and a mode particle size may be obtained.

In the present invention, the mode particle size of image forming elements is required to be 5 μm or larger because if the mode particle size is below 5 μm, there is lowered the image density of a transferred image which has been formed by transferring a transferable image formed in the transfer recording layer to a transfer-receiving medium. On the other hand, the mode particle size is required to the 25 μm or less because if it is above 25 μm, the energy required for the change in the transfer characteristic increases to lower the recording speed, or the resolution of the transferred image is lowered.

Further, in the transfer recording medium according to the present invention, it is important that the deviation or variation in the particle size distribution of the image forming elements is small. More specifically, in the present invention, it is required that the image forming elements comprise 50% by number or more, preferably 70% by number or more, of those having a particle size of ±4 μm or less preferably ±2 μm or less, counted from the mode particle size of the image forming elements.

If the proportion of the image forming elements having a particle size of ±4 μm or less counted from the mode particle size is below 50% by number, the proportion of image forming elements having a smaller or lager particle size increases whereby the above-mentioned problems or a problem of fog is caused.

The propotion of image forming elements having a prescribed particle size to the total number thereof may be determined by using the particle size distribution of the image forming elements obtained as described above.

In the present invention, when 80% by number or more of the image forming elements having a mode particle size of 5–25 μm and having a particle size of ±4 μm or less counted from the mode particle size, substantially have a spherical shape, i.e., satisfy a condition of $1.00 \leqq$ (longer axis A)/(shorter axis B) $\leqq 1.25$, better results i.e., an image without unevenness having higher resolution, may be obtained in image formation.

In the present invention, there may be confirmed whether the 80% by number or more of image forming elements satisfy the above-mentioned condition with respect to the shape thereof, in basically the same manner as in the above-mentioned measurement of the mode particle size.

In this case, however, an absolute maximum length (corresponding to the longer axis A) and an absolute minimum length (i.e., the minimum length of distance between two parallel lines which are parallel to the longer axis and sandwich therebetween the periphery of each particle image) corresponding to the shoter axis B may be measured in a similar manner as described above and then the ratios (A/B) are calculated with respect to the respective image forming elements in a measurement area which have a particle size of ±4 μm or less counted from the mode particle size.

Such operation is repeated, while changing the measurement position so that the total number of the measured image forming elements becomes at least 500, whereby there is obtained a distribution by number with respect to the above ratios A/B. Then, the proportion by number of particles satisfying $1.00 \leqq A/B \leqq 1.25$ may be determined by using the thus obtained distribution.

In the present invention, in order to confirm whether 80% by number or more image forming elements satisfy the above-mentioned condition with respect to the shape thereof, it is sufficient that 80% by number or more of at least 500 particles of image forming elements, which are sampled from those having a mode particle size of 5–25 μm and having a particle size of ±4 μm or less counted from the mode particle size, are observed to satisfy the above condition. The longer axis A and the shorter axis B of the at least 500 particles of image forming elements may be examined according to the above-mentioned image processing method.

Accordingly, in the preferred embodiment of the present invention, it is defined as described above that 80% by number of the image forming elements satisfy the condition of $1.00 \leqq A/B \leqq 1.25$.

In a transfer recording method using the transfer recording medium according to the present invention, the image forming elements are caused to contact a transfer-receiving medium and are transferred to the transfer-receiving medium thereby to form a recorded image. Therefore, in order to obtain a clear recorded image having good contrast, it is desirable that the adhesions between the respective image forming elements and the transfer-receiving medium are substantially uniform.

Thus, in this recording method, as compared with the conventional recording method using capsules capable of being ruptured by pressure, it is required that the contact areas between the respective image forming elements and the transfer-receiving medium are substantially equalized with respect to the respective image forming elements by uniformizing the sizes of the image forming elements.

Further, in the present invention, in order to uniformize the adhesions between the respective image forming elements and the transfer-receiving medium, it is required that the respective image forming elements have substantially uniform reactivity or reaction characteristics. The size of the solid image forming element has much effect on the reactivity thereof, as compared with that of a capsule having a liquid core. Therefore, with respect to the solid image forming elements, the uniformity in the sizes thereof is important in order to uniformize the adhesions between the respective image forming elements and a transfer-receiving medium.

The functional component used in the transfer recording medium according to the present invention comprises at least a photo-initiator and a polymerizing component comprising a monomer, oligomer or prepolymer having an unsaturated double bond (i.e., an ethylenic double bond).

The photo-initiator may preferably be a radical generator such as azo compounds, organic sulfur compounds, carbonyl compounds, and halogen compounds. Specific examples of the photo-initiator used for this purpose include; carbonyl compounds such as benzophenone, benzil, benzoin ethyl ether, and 4-N,N-dimethylamino-4'-methoxybenzophenone; organic sulfur compounds such as dibutyl sulfide, benzyl disulfide, and decyl phenyl sulfide; peroxides such as di-tert-butyl peroxide, and benzoyl peroxide; halogen compounds such as carbon tetrachloride, silver bromide, and 2-naphthalenesulfonyl chloride; nitrogen compounds such as azobisisobutyronitrile, and benzenediazonium chloride.

With respect to the amount of the photo-initiator contained in the functional component according to the present invention, the weight ratio of the photo-initiator to a compound having an unsaturated double bond (i.e., a polymerizing component having an ethylenic unsaturated double bond) may preferably be in a range of about 1:5 to about 1:1000, more preferably about 1:10 to about 1:100.

A monomer, oligomer or prepolymer having an unsaturated double bond used in the present invention, may include: urethane acrylates or urethane methacrylates having a urethane bond synthesized by a polyaddition reaction of a polyisocyanate (optionally reacted with a polyol, as desired) with an alcohol or amine having an unsaturated double bond; epoxyacrylates synthesized by an addition reaction of an epoxy resin with acrylic acid or methacrylic acid; polyester acrylates, spin acrylates, or polyether acrylates. The monomer, oligomer or prepolymer used in the present invention, however, is not restricted to these compounds Further, in the present invention, there may be used a prepolymer comprising a skeleton of polyalkylene, polyether, polyester or polyurethane as a main chain, to which a polymerizing or crosslinking reactive group represented by an acrylic group, a methacrylic group, a cinnamoyl group, a cinnamylideneacetyl group, a furylacryloyl group or a cinnamic acid ester group, is introduced as a side chain. The prepolymer used in the present invention is not restricted to these compounds.

The above-mentioned monomer, oligomer or prepolymer may preferably be solid at normal temperature or room temperature. Further, the above monomer, oligomer or prepolymer having an unsaturated double bond, and the photo-initiator may be used in combination with a binder component.

As the binder component, known organic polymers may be used. Examples of such organic polymer may include: polymers obtained by addition polymerization such as methacrylic acid copolymers, acrylic acid copolymers, itaconic acid copolymers, partially esterified maleic acid copolymers, maleic acid copolymers, etc.; chlorinated polyolefins such as chlorinated polyethylene and chlorinated polypropylene; polymthyl methacrylate, polyacrylic acid, polymethacrylic acid, polyacrylic acid alkyl esters, copolymers comprising an acrylic acid alkyl ester and acrylonitrile, vinyl chloride, vinylidene chloride, styrene or butadiene, etc.; polyvinyl chloride, copolymers of vinyl chloride and acrylonitrile, polyvinylidene chloride, copolymers of vinylidene chloride and acrylonitrile, polyvinyl acetate, copolymers of vinyl acetate and vinyl chloride, polyvinyl alcohol, polyvinyl pyrrolidone, polyacrylonitrile, copolymers of acrylonitrile and styrene, copolymers of acrylonitrile and butadiene and styrene, polyvinyl alkyl ether, polymethyl vinyl ketone, polyethyl vinyl ketone, polyethylene, polypropylene, polystyrene, polyamide, polybutadiene, polyisoprene, polyurethane, polyethylene terephthalate, chlorinated rubber, polychloroprene, styrene-butadiene copolymers; etc.

Among these polymers, there may preferably be used chlorinated polyethylene, polymethyl methacrylate, polyvinyl chloride, vinylidene chloride-acrylonitrile copolymers, polyethylene, styrene-acrylic copolymers, polyvinyl butyral, polyvinyl acetate, vinyl chloride-vinyl acetate copolymers, chlorinated rubber, etc.

These binder components may be used singly or as a mixture of two or more species. The binder content may be 0–90 wt. % based on the weight of the image forming element.

Further, waxes may be used as the binder component. Examples of such wax may include: vegetable waxes such as candelilla wax, carnauba wax and rice wax, animal waxes such as beeswax and whale wax, mineral waxes such as ceresine wax and montan wax, petroleum waxes such as paraffin wax; and synthetic waxes including polyethylene wax, sasol wax, montan wax derivatives, paraffin wax derivatives, hardened castor oil, hardened castor oil derivatives, fatty acids such as stearic acid, fatty acid amides, fatty acid esters. These waxes may be used singly or as a mixture of two or more species.

The coloring component or colorant is a component to provide an optically recognizable image and may be appropriately selected from various pigments and dyes. Specific examples of the colorant include: inorganic pigments such as carbon black, lead yellow, molybdenum red and red iron oxide; organic pigments such as Hansa Yellow, Benzidine Yellow, Brilliant Carmine 6B, Lake Red F5R, Phthalocyanine Blue, Victoria Blue Lake, and Fast Sky Blue; leuco dyes, and phthalocyanine dyes.

The colorant content may preferably be 0.1–30 wt. parts, based on the weight of the functional component and the binder component.

The transfer recording medium according to the present invention comprises a substrate and particulate image forming elements carried thereon which are solid at room temperature.

In order to carry the image forming elements on the substrate, for example, a binder for application such as polyvinyl alcohol (PVA) and an epoxy-type adhesive may be applied onto the substrate and the image forming elements may be disposed or distributed on the binder for application. The thickness of the binder for application may preferably be 0.1–1 μm.

Alternatively, the image forming elements may be attached to a substrate electrostatically. In this case, one of or both of the particulate image forming element and the substrate may be corona-charged or triboelectrically charged, and they may be attached to each other.

With respect to the distribution of the image forming elements disposed on the substrate, the proportion of the projection area of the image forming elements to the surface area of the substrate may preferably be 50% or more. Further, it is preferred that the image forming elements may be distributed in a substantially mono-particle layer, while they may be distributed partially in a multi-particle layer.

The transfer recording medium of the present invention may suitably be prepared by attaching the image forming elements to a substrate physically or chemically. In a typical chemical method, a functional group may be introduced to the respective surfaces of the image forming element and the substrate contacting each other, and these may be chemically bound.

The image forming element may be prepared, e.g., by mixing a functional component, a colorant and an optional additive such as a stabilizer and spray-drying the resultant micture. In a case where the image forming element is encapsulated aggregation or agglomeration of the image forming element particles may desirably be suppressed in a transfer step. Further, encapsulation of the image forming element is preferred in order to effect a high-speed recording by using the transfer recording medium of the present invention.

Figure 5:
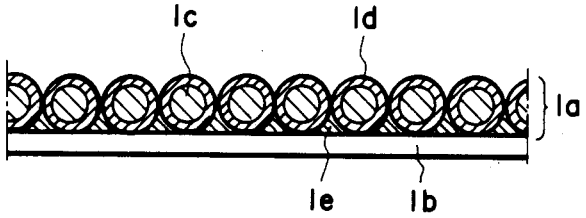
FIG. 5 is a schematic sectional view showing an embodiment of the transfer recording medium according to the present invention which comprises image forming elements in the form of microcapsules.

When the image forming elements constituting the transfer recording layer is provided in the form of microcapsules as shown in FIG. 5, the core 1*c* of the capsules may be formed of the above-mentioned materials for the transfer recording layer.

On the other hand, the wall 1*d* of the microcapsules may for example be forced of a material including: gelatine, gelatine-gum arabic, sodium alginate, polyvinyl alcohol, cellulosic resins such as ethyl cellulose and nitrocellulose, urea-formalin resin, resorcinol-formaldehyde resin, urea-formaldehyde resin, isocyanate-polyol resin, melamine-formaldehyde resin, hydroxypropylcellulose, polyvinyl chloride, polyvinyl chloride-cellulose, acetate butyrate, polyvinyl acetate, polystyrene, polyethylene, polymethyl methacrylate, polyamide, styrene-acrylonitrile copolymer, vinylidene chloride-acrylonitrile copolymer, epoxy resin, polyvinyl formal, vinyl chloride-vinyl acetate copolymer, polyester, polyacrylic acid ester, butyl acetate cellulose, polyvinyl pyrrolidone, polyvinylidene chloride, nylon, tetoron, polyurethane, polycarbonate, maleic anhydride-type copolymer, polyethylene terephthalate, etc.

In a case where the image forming element is in the form of a microcapsule, the wall material thereof may preferably have a thickness of 0.1–2.0μ, more preferably 0.1–0.5μ.

Known methods may be used as a process for preparing the microcapsular image forming element. For example, there may be used simple coacervation method, complex coacervation method, interfacial polymerization method, in-situ polymerization method, interfacial precipitation method, phase-separation method, spray-drying method, air-suspension encapsulation method, mechanochemical method, etc.

The microcapsular image forming elements may be bonded to the substrate in a similar manner as described above.

The substrate or support to be used in the transfer recording medium according to the present invention is not particularly limited, but may be polyester, polycarbonate, triacetylcellulose, nylon, polyimide, polyethylene terephthalate, or metal such as aluminum, etc. The form of the substrate may arbitrarily selected from, e.g., a film or sheet, plate, drum, or sphere, depending on an intended use.

The image forming elements satisfying the condition of $1.00 \leqq A/B \leqq 1.25$ may be prepared by dissolving the components constituting the image forming element in an organic solvent and then spray-drying the resultant mixture by means of an apparatus such as a spray-drier. In this case, it is preferred that the solution of the above components has a low viscosity, preferably 10,000 cps or below.

Alternatively, the image forming elements satisfying the above condition may also be prepared by mechanically granulating a solution of the components containing a surfactant etc., in water by means of a homomixer, etc.

In the transfer recording medium according to the present invention, in order to prevent reduction in the sensitivity due to oxygen, a removable transparent cover, or a coating layer having a low permeability to oxygen as disclosed in Japanese Patent Publication No. 17828/1965 (JP-B 40-17828) may be disposed on the transfer recording layer.

In the transfer recording medium of the present invention, it is possible that the radical reactivity of the transfer recording layer is suppressed because of oxygen in the air. In order to obviate this difficulty, it is preferred to provide an oxygen-shielding layer by applying an aqueous polyvinyl alcohol solution containing a small amount of a surfactant on the transfer recording layer. The oxygen-shielding layer may be received after the transferable image formation by washing with water. In case of image forming elements in the form of microcapsules, it is possible to have the walls show a function of the oxygen-shielding layer.

Hereinbelow, the present invention will be described by way of Examples.

Incidentally, in the Examples hereinafter, a transfer rate is represented by a rate by number of transferred image forming elements to the total number of those distributed in the area of 1 cm×1 cm of a transfer recording layer. More specifically, the transfer rate is determined in the following manner.

(1) In the area of 1 cm×1 cm of a transfer recording layer disposed on a substrate, the number of the image forming element particles before a transfer is measured by detecting the images thereof through an optical microscope by means of a television camera. In the measurement of the number of the particles, several areas of 500 μm×500 μm are further selected from the above-mentioned 1 cm×1 cm area, and the numbers of the image forming element particles disposed in these 500μm×500μm areas are measured and summed so that the sum of the number of the image forming element particles may be 1,000 or more.

(2) A solid image (i.e., an image having solid density) is transferred onto a transfer-receiving medium by using the 1 cm×1 cm area of the transfer recording layer, and the number of the image forming element particles remaining on the above-mentioned 1 cm×1 cm area of the substrate side is measured in a similar manner as described in the measurement of (1). In this case, 500μm×500 μm areas in which the numbers of the particles are measured are selected so that these areas are positioned almost the same as in the measurement of (1).

(3) On the basis of the numbers of particles obtained in the above measurements, the transfer rate is calculated according to the following formula: transfer rate (%)={[(number of particles measured in (1))−(number of particles measured in (2))]/(number of particles measured in (1))}×100.

Further, the image density was measured by means of a reflection density meter, Model RD-914 (mfd. by Macbeth Co.).

EXAMPLE 1

TABLE 1

| Item | Component | wt. % |
|---|---|---|
| Binder component | poly(4,4'-isopropylidenediphenylene-1,1,3-trimethyl-3-phenylindane-5,4'-dicarboxylate:azelate) (25:75): p,p'-dihydroxybiphenyl* | 50 |
| Polymerizing component | tri(6-acryloyloxyhexyl)-1,3,5-benzenetricarboxylate | 20 |
| Photo-initiator | benzophenone + Michler's ketone (1:6 mixture) | 8 |
| Stabilizer | hydroquinone | 2 |
| Colorant | carbon black | 20 |

*a copolymer system obtained by the reaction of a dicarboxylic acid comprising poly[4,4'-iso-propylidenediphenylene-1,1,3-trimethyl-3-phenylindan-5,4'-dicarboxylate:azelate] (25:75) with an alcoholic component comprising 4,4'-dihydroxybiphenyl.

10 g of a mixture of components shown in Table 1 was mixed with 20 g of methylene chloride. The resultant mixture was further mixed with a solution obtained by dissolving a cationic or nonionic surfactant having an HLB of at least 10 and 1 g of gelatine in 200 ml of water, and the mixture was further emulsified by means of a homomixer at 8,000–10,000 rpm, on heating at 60° C., thereby to obtain oil droplets having an average particle size of 30 microns. The mixture was further stirred for 30 min. at 60° C., and then the methylene chloride was distilled off thereby to obtain oil droplets having an average particle size of 15μ.

Then, a solution obtained by dissolving 1 g of gum arabic in 20 ml of water was added to the above-prepared mixture. A 10% $NH_4OH$ (aqueous ammonia solution) was added to the resultant mixture, while cooled slowly, to adjust the pH to 11 or higher, whereby a microcapsule slurry was prepared. Thereafter, 101 ml of a 20% aqueous glutaraldehyde solution was slowly added to the slurry thereby to harden the microcapsule walls.

The slurry was subjected to solid-liquid separation by means of a Nutsche funnel, and the solid was dried at 35° C. for 10 hours in a vacuum drier to obtain microcapsular image forming elements.

Separately, an epoxy-type binder 1*e* was applied onto a substrate of 6 μ-thick polyethylene terephthalate film so as to form a 1 μm-thick layer, and then the above-prepared image forming elements were attached thereto whereby a transfer recording medium as shown in FIG. 5 was prepared.

Figure 7:
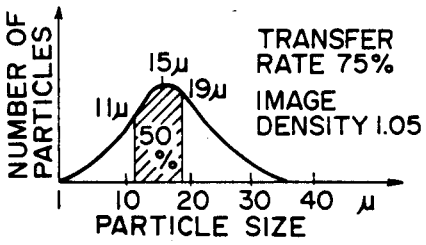
FIGS. 7–11 are graphs respectively showing particle size distributions of Examples and Comparative Example 1.

The particle size distribution of the image forming elements of the thus prePared transfer recording medium was measured by use of image processing as described above. As a result, the following values were obtained.

minimum particle size: 1 μm,
maximum particle size: 35 μm,
mode particle size: 15 μm,
number of particles having a particle size of 11–19 μm: 50% by number The thus obtained particle size distribution is shown in FIG. 7.

Then, about 500 particles of image forming elements were sampled and the shapes of these particles were detected by means of a television camera, and observed by means of an image-analyzing device (Real-time Image Processor, TVIP-2000, mfd. by Nippon Abionix K.K.). As a result, it was found that image forming elements having a ratio of the longer axis A to the shorter axis B (A/B) of 1.05 or less were present in a proportion of 82% by number.

Figure 3:
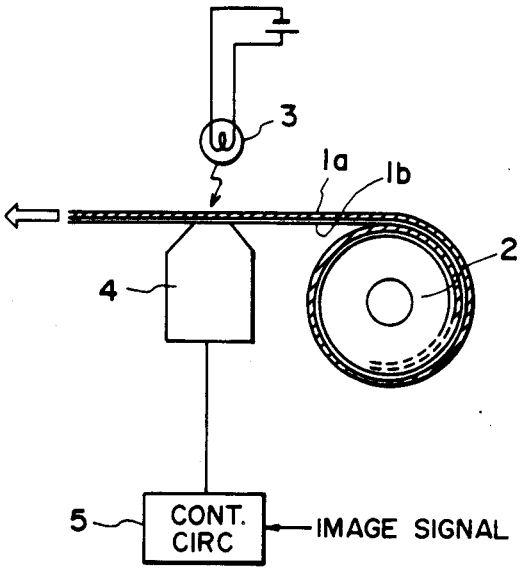
FIGS. 3 and 4 are respectively a schematic side view showing an example of a system arrangement to which the transfer recording medium according to the present invention is set.
Figure 4:
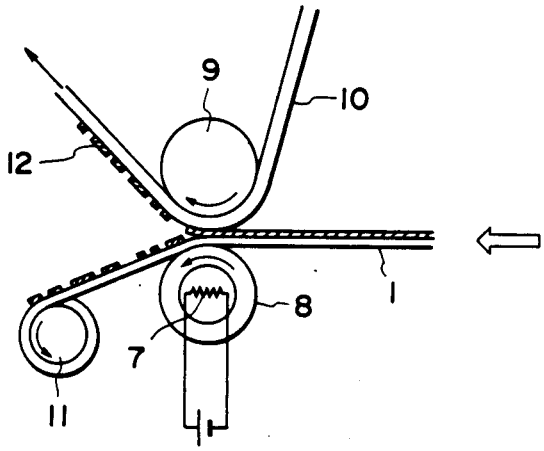

Then, the thus prepared transfer recording medium 1 was wound up in a roll and set in an apparatus as shown in FIG. 3.

The thermal head 4 was a line-type one of 8 dots/mm - A4 size having a heating element row at its edge portion. The heating element row was so disposed that it might contact the substrate 1*b* side of the transfer recording medium 1 under a pressure based on the tension of the transfer recording medium 1.

On the other hand, in the side of the transfer recording layer 1*a*, opposite to the thermal head 4, a chemical lamp 3 (radiation peak: 370 nm, FLR16A70-37/33 T16, mfd. by Matsushita K.K.) was disposed.

The heating elements of the thermal head 4 were energized under control by a control circuit 5 based on image signals. In this embodiment, the transfer recording layer 1*a* had such a property that the transfer initiation temperature increased when provided with light and heat through increase in glass transition temperature thereof, so that a negative type of recording was effected. Thus, the thermal head 4 was not energized in response to a mark signal (black) but was energized in response to a non-mark signal (white) to generate heat at a current energy of 0.8 W/dot×10 μmsec.

In the above described manner, while effecting uniform illumination by using the chemical lamp, the thermal head 4 was energized under control based on image signals, while the transfer recording medium 1 was conveyed by a stepping motor and a driving rubber roller (not shown) in synthronism with the operation in a repetition cycle of 20 msec/line.

After a transferable image was formed in this way, plain paper 10 with a surface smoothness of 10–30 sec was superposed onto the transfer recording layer 1*a* of the transfer medium 1. The resultant laminate was conveyed through a heat roller 8 and a pinch roller 9. The heat roller 8 was an aluminum roller having a 300 W-heater 7 inside thereof and covered with a 2 mm-thick silicone rubber layer. The surface temperature of the heat roller 8 could be controlled at a desired temperature in the range of 50–150° C. by the heater. The pinch roller 9 was made of a silicone rubber having a hardness of 50° according to a JIS rubber hardness meter and controlled to exert a pressure of 1–1.5 kg/cm$^2$.

Thus, the transfer recording medium 1 was superposed onto the plain paper 10 so that the transfer recording layer 1*a* contacted the paper 10, and the resultant laminate was conveyed while the surface temperature of the heat roller 8 was controlled at 90–150° C. Thereafter, the substrate film 1*b* was peeled from the paper 10 whereby a transferred image 12 of high quality without fog having a good fixation characteristic could be formed on the plain paper.

The transfer rate in the transfer to the plain paper was 75% by number, and the image density of the transferred image was 1.05.

EXAMPLE 2

The image forming elements prepared in Example 1 were classified by means of a classifier. The thus obtained image forming elements were carried on a substrate in a similar manner as in Example 1 to prepare a transfer recording medium.

Figure 8:
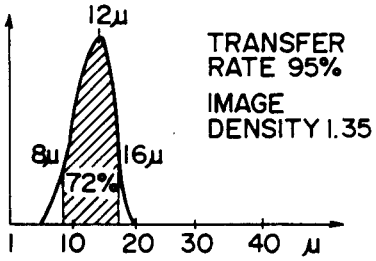
Figure 10:
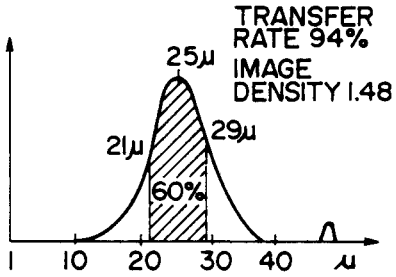

The particle size distribution of the image forming elements of the thus prepared transfer recording medium was measured by use of image processing as described above. As a result, the following values were obtained.

minimum particle size: 5 μm,
maximum particle size: 20 μm,
mode particle size: 12 μm,
number of particles having a particle size of 8–16 μm: 72% by number The particle size distribution of the above image forming elements is shown in FIG. 8. Further, it was found that image forming elements having a ratio of the longer axis A to the shorter axis B (A/B) of 1.23 or less were present in a proportion of 95% by number.

Figure 12:
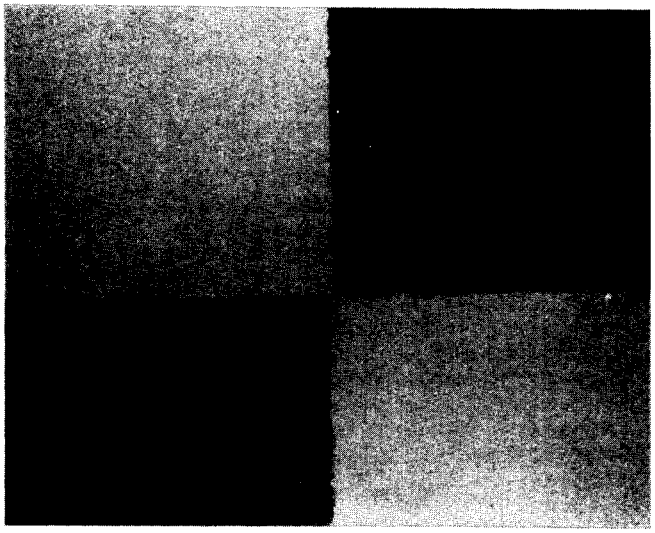
FIG. 12 is an enlarged photograph of a transferred image formed on plain paper by using a transfer recording medium of Example 2.

By using the thus obtained transfer recording medium, a transferred image was formed on plain paper in a similar manner as in Example 1. As a result, the obtained image was clear and free of fog, as shown in an enlarged photograph (magnification: ×15) of FIG. 12.

The transfer rate in the transfer to the plain paper was 95% by number, and the transferred image had good resolution and an image density of 1.35.

Figure 13:
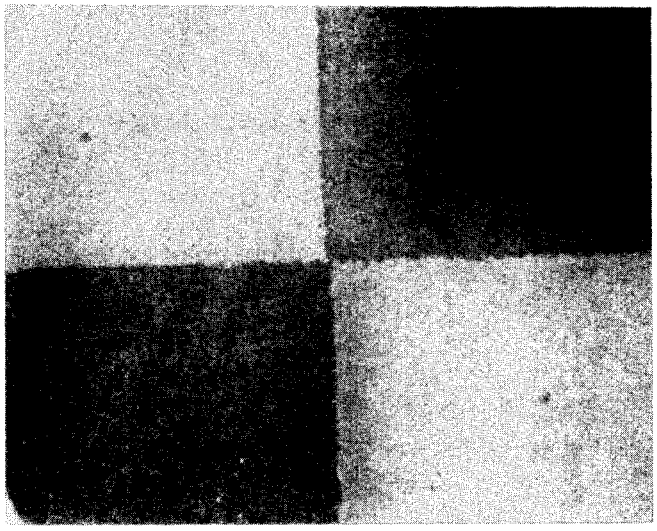
FIG. 13 is an enlarged photograph of the transfer recording layer of the transfer recording medium of Example 2 after a transfer recording is effected on plain paper.

Incidentally, FIG. 13 shows an enlarged photograph (magnification: ×15) of the transfer recording layer after the transferred image was formed on the plain paper in this Example.

EXAMPLE 3

By using the same components as in Example 1, microcapsular image forming elements were prepared in the same manner as in Example 1 except that the stirring by the homomixer was effected on heating at 80° C.

The thus obtained image forming elements were carried on a substrate in a similar manner as in Example 1 to prepare a transfer recording medium.

Figure 9:
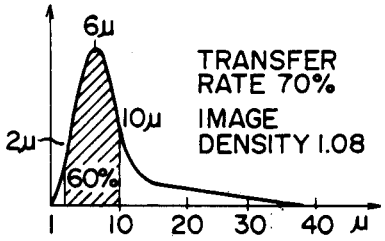

The particle size distribution of the image forming elements of the thus prepared transfer recording medium was measured by use of image processing as described above. As a result, the following values were obtained.

minimum particle size: 1 μm,
maximum particle size: 38 μm,
mode particle size: 6 μm,
number of particles having a particle size of 2–10 μm: 60% by number The thus obtained particle size distribution is shown in FIG. 9.

By using the transfer recording medium obtained above, a transferred image was formed on plain paper in a similar manner as in Example 1. As a result, the obtained image was clear, free of fog, and had good fixation characteristic.

The transfer rate was 70% by number, and the image density of the transferred image was 1.08.

COMPARATIVE EXAMPLE 1

By using the same components as in Example 1, microcapsular image forming elements were prepared in the same manner as in Example 1 except that the stirring by the homomixer was effected at 3,000 rpm.

The thus obtained image forming elements were carried on a substrate in a similar manner as in Example 1 to prepare a transfer recording medium.

Figure 11:
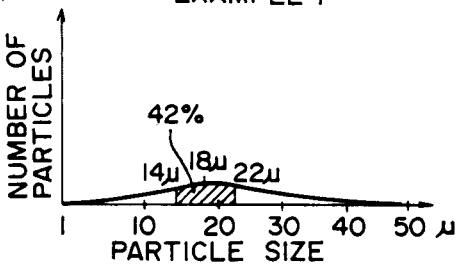

The particle size distribution of the image forming elements of the thus prepared transfer recording medium was measured by use of image processing as described above. As a result, the following values were obtained.

minimum particle size: 1 μm,
maximum particle size: 50 μm,
number of particles having a particle size of 14–22 μm: 42% by number The thus obtained particle size distribution is shown in FIG. 11.

With respect to the ratio (A/B) of a longer axis A to a shorter axis B, it was found that image forming elements having a ratio A/B of 1.38 or more were present in a proportion of 30% by number, those having a ratio A/B of 1.38–1.26 were present in a proportion of 40% by number, and those having a ratio A/B of 1.25 or less were present in a proportion of 30% by number.

Figure 14:
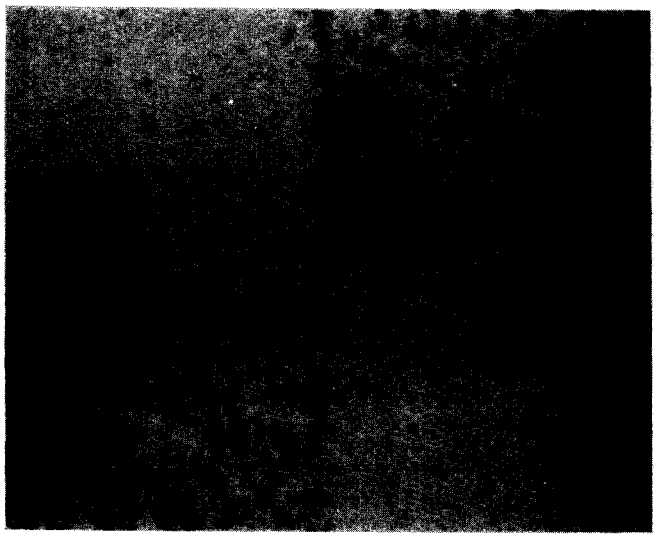
FIG. 14 is an enlarged photograph of a transferred image formed on plain paper by using a transfer recording medium of Comparative Example 1.

By using the above transfer recording medium, a transferred image was formed in a similar manner as in Example 1. As a result, there could be obtained only a transferred image of low quality with much fog, much white dropping and low resolution, as shown in an enlarged photograph (magnification: ×15) of FIG. 14.

The transfer rate was 30 % by number, and the image density of the transferred image was 0.52.

Figure 15:
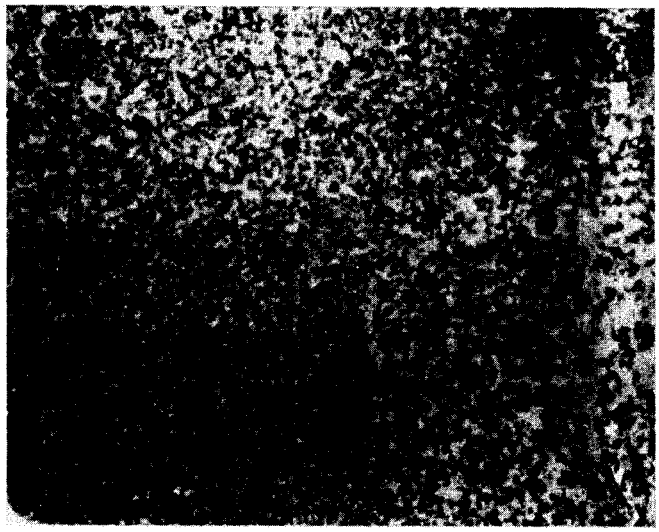
FIG. 15 is an enlarged photograph of the transfer recording layer of the transfer recording medium of Comparative Example 1 after a transfer recording is effected on plain paper.

Incidentally, FIG. 15 shows an enlarged photograph (magnification: ×15) of the transfer recording layer after the transferred image was formed on the plain paper in this Comparative Example.

EXAMPLE 4

The image forming elements prepared in Example 1 were classified by means of a classifier.

The thus obtained image forming elements were carried on a substrate in a similar manner as in Example 1 to prepare a transfer recording medium.

The particle size distribution of the image forming elements of the thus prepared transfer recording medium was measured by use of image processing as described above. As a result, the following values were obtained.

minimum particle size: 6 μm,
maximum particle size: 38 μm,
mode particle size: 25 μm,
number of particles having a particle size of 21–29 μm: 60% by number With respect to the ratio (A/B) of a longer axis A to a shorter axis B, it was found that image forming elements having a ratio A/B of 1.35 or more were present in a proportion of 5% by number, those having a ratio A/B of 1.34–1.26 were present in a proportion of 10% by number, and those having a ratio A/B of 1.25 or less were present in a proportion of 85% by number.

Further, by using the thus obtained transfer recording medium, a transferred image was formed on plain paper in a similar manner as in Example 1. As a result, the obtained image was clear, free of fog, and had good fixation characteristic. The transfer rate was 94% by number, and the image density of the transferred image was 1.48.

EXAMPLE 5

TABLE 2

| Item | Component | wt. % |
|---|---|---|
| Binder component | polymethyl methacrylate (Elvasite 2041, mfd. by Du Pont) | 15 |
| Polymerizing component | $(CH_2{=}CHCOOCH_2CH_2O.CO.NH{-}\langle H \rangle)_2 CH_2$ | 72 |
| Photo-initiator | 2-chlorothioxanthon | 4 |
| | ethyl p-dimethylaminobenzoate | 6 |
| Colorant | Diaresin Red K (mfd. by Mistubishi Kasei Kogyo K.K.) | 3 |

TABLE 3

| Item | Component | wt. % |
|---|---|---|
| Binder component | polymethyl methacrylate (Elvasite 2041, mfd. by Du Pont) | 15 |
| Polymerizing component | $(CH_2{=}CHCOOCH_2CH_2O.CO.NH{-}\langle H \rangle)_2 CH_2$ | 72 |
| Photoinitiator | dichlorobenzophenone | 4 |
| | ethyl p-dimethylaminobenzoate | 6 |
| Colorant | Lionel Blue FG 7330 (mfd. by Toyo Inki Seizo K.K.) | 3 |

A transfer recording medium according to the present invention was prepared by separately using the above components shown in Table 2 and Table 3.

Thus, 0.60 part of fine powder silica (RA-200, mfd. by Nippon Aerosil K.K.) was added to a mixture comprising 18 parts of 0.1N-hydrochloric acid and 20 parts of water, and was dispersed therein. To 40 parts of the resultant dispersion, 60 parts of a 25% solution obtained by dissolving the components shown in Table 2 in methylene chloride was added, and the resultant mixture was stirred for 10 min. by means of a homogenizer at 6,000 rpm at room temperature, thereby to effect granulation. The resultant dispersion was further stirred for 3 hours on heating at 50° C.

The resultant dispersion was further mixed with a solution obtained by dissolving a cationic or nonionic surfactant having an HLB of at least 10, 1 g of gelatine and 1 g of gum arabic in 200 ml of water, and the mixture was further stirred by means of a homomixer at 3,000 rpm.

A 10% $NH_4OH$ (aqueous ammonia solution) was added to the resultant mixture, to adjust the pH to 11 or higher, whereby a microcapsule slurry was prepared.

The slurry was subjected to solid-liquid separation by means of a filter, and the solid was dried at 35° C. for 10 hours in a vacuum drier to obtain microcapsular image forming elements. The thus obtained image forming element was a microcapsule wherein the components shown in Table 2 were encapsulated with the gelatine and gum arabic.

Separately, microcapsular image forming elements were prepared in the same manner as described above except for using the components shown in Table 3.

The thus prepared two species of image forming elements were respectively classified in a similar manner.

Referring to FIG. 5, the above-mentioned two species of image forming elements were sufficiently mixed and carried on a 5 μm-thick PET (polyethylene terephthalate) film by using an adhesive 1*e* comprising a polyester rein under a light-shielding condition thereby to obtain a transfer recording medium containing the components as shown in Tables 2 and 3.

The particle size distribution of the image forming elements of the thus prepared transfer recording medium was measured by use of image processing as described above. As a result, the following values were obtained.

minimum particle size: 4 μm,
maximum particle size: 24 μm,
mode particle size: 11 μm,
number of particles having a particle size of 7–15 μm: 59% by number Further, it was found that image forming elements having a ratio of the longer axis A to the shorter axis B (A/B) of 1.08 or less were present in a proportion of 84% by number.

Then, the thus prepared transfer recording medium was wound up in a roll and set in an apparatus as shown in FIG. 3. Incidentally, as a light source 3, there were disposed two lamps of Lamp A having a radiation peak of 390 nm (FL10A 70E39, mfd. by Toshiba K.K.), and Lamp B having a radiation peak of 335 nm (FL10A 70E35, mfd. by Toshiba K.K.).

Figure 6:
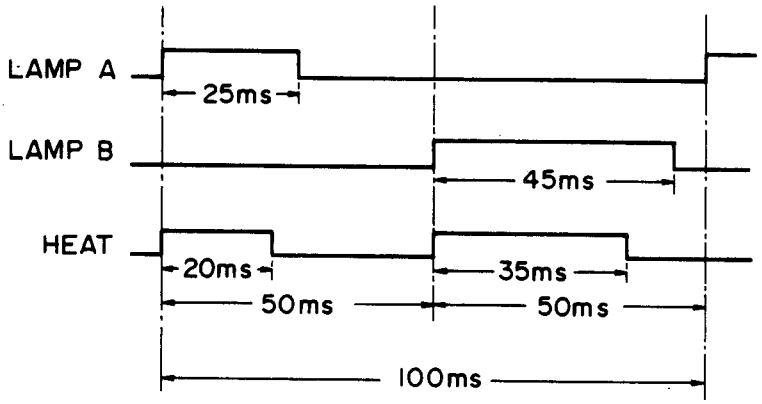
FIG. 6 is a timing chart for driving the heat and light energy sources used in an embodiment of the recording method using the transfer recording medium according to the present invention.

In this embodiment, the transfer recording layer 1*a* had such a property that the transferability to transfer-receiving paper was reduced when provided with heat and light having a prescribed wavelength through increase in softening temperature thereof. Therefore, when magenta-color recording was effected as shown in a driving timing chart of FIG. 6, a current was first supplied for 20 msec not to heating elements of the heating element row of the thermal head corresponding to an image signal of a "magenta", but to those corresponding to an image signal of "white" (in the case of a white transfer-receiving medium), while the Lamp A was simultaneously turned on to effect uniform illumination. The lummination time was 25 msec.

Then, with respect to blue-color recording, after 25 msec from the termination of the illumination (i.e,, after 50 msec from the initiation of the current supply), a current was supplied for 35 msec not to heating elements of the heating element row corresponding to an image signal of blue, but to heating elements corresponding to an image signal of "white", while the Lamp B was simultaneously turned on to effect uniform illumination. The illumination time was 45 msec.

In the above-described manner, the thermal head 4 was energized under control based on image signals of blue, magenta and white, thereby to form a negative-type transferable image in the transfer recording layer 1*a*, while the transfer recording medium 1 was conveyed in synchronism with the above operation in a repetition cycle of 100 msec/line.

Then, similarly as in Example 1 , plain paper was superposed onto the transfer recording layer 1*a* of the transfer medium 1, and the resultant laminate was pressed and heated whereby a two-color image comprising blue and magenta colors could be transferred onto the plain paper.

As described above, two-color recording could be effected at one-shot. In the thus obtained two-color image, the image density of the magenta portion was as sufficiently high as 1.32, and that of the blue portion was as sufficiently high as 1.29. Further, the obtained image was clear without fog or white dropping and had a good fixation characteristic.

COMPARATIVE EXAMPLE 2

The microcapsular image forming elements containing the components shown in Table 2, which had been prepared in Example 5 were classified to obtain image forming element having the following characteristics.

minimum particle size: 1 μm,
maximum particle size: 10 μm,
mode particle size: 3.5 μm,
number of particles having a particle size of 1–7.5 μm: 60% by number Similarly, the microcapsular image forming elements containing the components shown in Table 3, which has been prepared in Example 5 were classified to obtain image forming element having the following characteristics.

minimum particle size: 3 μm,
maximum particle size: 50.8 μm,
mode particle size: 35 μm,
number of particles having a particle size of 31–39 μm: 30% by number In each of the thus obtained two species of image forming elements, the characteristics with respect to the ratio (A/B) of the longer axis A to the shorter axis B were similar to those in Example 5.

A transfer recording medium was prepared in the same manner as in Example 5 by using a mixture comprising equal amounts of the above-mentioned two species of image forming elements. By using the thus prepared transfer recording medium, a transferred image was formed on plain paper in a similar manner as in Example 5.

As a result, in the magenta transferred image, it was found that about 50% by number of blue image forming element particles among those which had been present in the portion of the transfer recording layer corresponding to the above-mentioned magenta image were mixed. Further, the transfer rate with respect to the magenta particles was as low as about 20% by number. Thus, a muddy bluish purple color due to mixing of magenta with blue was shown.

On the other hand, in the blue transferred image, magenta fog was caused whereby a clear blue color could not be shown.

Further, the boundary between magenta and blue images was disturbed or confused whereby only images having low resolution could be obtained.

As described hereinabove, the transfer recording medium according to the present invention affords a recorded image having a high image density and high resolution, since the image forming elements contained therein have a mode particle size in the range of 5–25 μm.

Further, the image forming elements constituting the transfer recording layer comprise 50% by number or more of those having a particle size of ±4 μm or less counted from the mode particle size, whereby the transfer recording medium of the present invention affords a clear recorded image at a high transfer rate.

What is claimed is:

1. A transfer recording medium comprising a substrate and a transfer layer disposed thereon capable of irreversibly changing its transfer characteristic when simultaneously provided with light energy and heat energy wherein the transfer recording layer comprises image forming elements which are solid at room temperature and comprise at least a colorant and a functional component sensitive to the provision of light energy and heat energy; the functional component comprises at least a photo-initiator and a polymerizing component of a monomer, oligomer or prepolymer having an unsaturated double bond; the image forming elements have a mode particle size in the range of 5–25 μm and the image forming elements comprise, based on the total number of particles thereof, 50% by number or more of those having a particle size of ±4 μm or less counted from the mode particle size.

2. A transfer recording medium according to claim 1, wherein the image forming elements comprise 50% by number or more of those having a particle size of ±2 μm or less counted from the mode particle size.

3. A transfer recording medium according to claim 1, wherein the image forming elements comprise 70% by number or more of those having a particle size of ±4 μm or less counted from the mode particle size.

4. A transfer recording medium according to claim 1, wherein the image forming elements, which have a mode particle size in the range of 5–25 μm and have a particle size of ±4 μm or less counted from the mode particle size, comprise 80% by number or more of those having a ratio (A/B) of the longer axis A to the shorter axis B satisfying $1.00 \leqq A/B \leqq 1.25$.

5. A transfer recording medium according to claim 1, wherein the transfer recording layer comprises plural kinds of image forming elements containing different photo-initiators having mutually different sensitive wavelength regions.

6. A transfer recording medium according to claim 1, wherein the transfer recording layer comprises image forming elements in the form of microcapsules.

7. A transfer recording medium according to claim 6, wherein the transfer recording layer comprises plural kinds of microcapsules containing different photo-initiators having mutually different sensitive wavelength regions.

* * * * *

UNITED STATES PATENT AND TRADEMARK OFFICE

CERTIFICATE OF CORRECTION

PATENT NO. : 4,973,542

DATED : November 27, 1990

INVENTOR(S) : MASANORI TAKENOUCHI, ET AL.

It is certified that error appears in the above-identified patent and that said Letters Patent is hereby corrected as shown below:

ON THE TITLE PAGE,
IN [56] REFERENCES CITED

U.S. PATENT DOCUMENTS, "Matianoto et al." should read --Matsumoto et al.--.

COLUMN 1

Line 14, "Such" should read --One such--.
Line 36, "is" should read --it is--.
Line 41, "printer" should read --printed--.
Line 49, "are" should be deleted.
Line 59, "system" should read --systems--.

COLUMN 2

Line 12, "desired a" should read --desired to form a--.
Line 14, "attended" should read --attendant--.
Line 30, "visible," should read --visible--.
Line 32, "image" (second occurrence) should read --(image--.

COLUMN 4

Line 5, "meidum" should read --medium--.

COLUMN 5

Line 44, "ultil" should read --until--.

COLUMN 7

Line 50, "cyan C)," should read --cyan (C),--.

UNITED STATES PATENT AND TRADEMARK OFFICE

CERTIFICATE OF CORRECTION

PATENT NO. : 4,973,542

DATED : November 27, 1990

INVENTOR(S) : MASANORI TAKENOUCHI, ET AL.

It is certified that error appears in the above-identified patent and that said Letters Patent is hereby corrected as shown below:

COLUMN 9

Line 9, "are" should read --is--.

COLUMN 10

Line 2, "the" should read --be--.
Line 21, "lager" should read --larger--.
Line 23, "propotion" should read --proportion--.
Line 47, "shoter axis B" should read --shorter axis B--.

COLUMN 13

Line 50, "micture." should read --mixture.--.
Line 51, "encapsulated" should read --encapsulated,--
Line 58, "is" should read --are--.
Line 63, "forced" should read --formed--.

COLUMN 15

TABLE 1, Line 54, "phenylindan" should read --phenylindane--.

COLUMN 16

Line 21, "prePared" should read --prepared--.

COLUMN 17

Line 2,"synthronism" should read --synchronous movement--.

UNITED STATES PATENT AND TRADEMARK OFFICE

CERTIFICATE OF CORRECTION

PATENT NO. : 4,973,542

DATED : November 27, 1990

INVENTOR(S) : MASANORI TAKENOUCHI, ET AL.

It is certified that error appears in the above-identified patent and that said Letters Patent is hereby corrected as shown below:

COLUMN 19

TABLE 2, "Mistubishi" should read --Mitsubishi--.

COLUMN 21

Line 21, "lummination" should read --illumination--.
Line 63, "has" should read --had--.

COLUMN 22

Line 48, "energy" should read --energy;--.

Signed and Sealed this

Eighth Day of September, 1992

*Attest:*

DOUGLAS B. COMER

*Attesting Officer*

*Acting Commissioner of Patents and Trademarks*